US008781367B2

(12) United States Patent
Tamura

(10) Patent No.: US 8,781,367 B2
(45) Date of Patent: Jul. 15, 2014

(54) IMAGE FORMING APPARATUS AND PROCESSING APPARATUS WITH A ROTATABLE COVER UNIT THAT INCLUDES A CLUTCH AND TRANSMISSION MEMBER

(71) Applicant: KYOCERA Document Solutions Inc., Osaka (JP)

(72) Inventor: Yuki Tamura, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/660,270

(22) Filed: Oct. 25, 2012

(65) Prior Publication Data

US 2013/0108324 A1 May 2, 2013

(30) Foreign Application Priority Data

Oct. 28, 2011 (JP) ..... 2011-237780

(51) Int. Cl.
*G03G 15/00* (2006.01)
*G03G 21/16* (2006.01)
*G03G 21/18* (2006.01)

(52) U.S. Cl.
CPC ..... *G03G 21/1647* (2013.01); *G03G 21/1864* (2013.01)
USPC ..... 399/167; 399/111

(58) Field of Classification Search
CPC ..... G03G 21/1633; G03G 21/1857; G03G 15/757; G03G 21/1864
USPC ..... 399/110–111, 167; 192/69.8
See application file for complete search history.

(56) References Cited

U.S. PATENT DOCUMENTS

| | | | | |
|---|---|---|---|---|
| 4,555,173 | A * | 11/1985 | Iseki et al. | 399/125 |
| 5,047,803 | A * | 9/1991 | Kanoto | 399/111 |
| 7,577,382 | B2 * | 8/2009 | Sato et al. | 399/167 |
| 7,778,569 | B2 * | 8/2010 | Igarashi | 399/110 |
| 7,933,536 | B2 | 4/2011 | Ogawa | |

(Continued)

FOREIGN PATENT DOCUMENTS

| | | |
|---|---|---|
| JP | 2003-208024 | 7/2003 |
| JP | 2008-304704 | 12/2008 |

OTHER PUBLICATIONS

Shikato, Masanobu. "Process Cartridge Driving Mechanism for Image Forming Device". May 9, 1989. Patent Abstracts of Japan.*

*Primary Examiner* — Clayton E Laballe
*Assistant Examiner* — Trevor J Bervik
(74) *Attorney, Agent, or Firm* — Gerald E. Hespos; Michael J. Porco; Matthew T. Hespos

(57) ABSTRACT

An image forming apparatus includes a housing with cover for covering and uncovering an opening in communication with an internal space. A drive portion generates a drive force that is transmitted intermittently by a clutch mechanism. The clutch mechanism includes a transmission member with first a transmission portion that receives a drive force from the drive portion and a second transmission portion that engages an image forming portion. A link mechanism reciprocates the transmission member in a first direction in which the transmission member moves away from image forming portion and a second direction opposite the first direction. A flexible link connects the cover to the link mechanism. The link mechanism coordinates with cover and moves the transmission member in the first direction when the cover uncovers the opening. The link mechanism coordinates with cover and moves the transmission member in the second direction when cover covers the opening.

9 Claims, 14 Drawing Sheets

(56) References Cited

U.S. PATENT DOCUMENTS

| | | | | |
|---|---|---|---|---|
| 8,311,448 | B2 * | 11/2012 | Hashimoto | 399/110 |
| 8,369,746 | B2 * | 2/2013 | Tamura | 399/167 |
| 2003/0138270 | A1 | 7/2003 | Matsuoka | |
| 2008/0304861 | A1 | 12/2008 | Ogawa | |
| 2011/0081163 | A1 * | 4/2011 | Lee | 399/110 |
| 2012/0219324 | A1 * | 8/2012 | Masuda | 399/122 |

* cited by examiner

IMAGE FORMING APPARATUS AND PROCESSING APPARATUS WITH A ROTATABLE COVER UNIT THAT INCLUDES A CLUTCH AND TRANSMISSION MEMBER

RELATED APPLICATIONS

This application claims priority to Japanese Patent Application Serial Number 2011-237780, filed on Oct. 28, 2011 by at least one common inventor, and which is incorporated herein by reference in its entirety.

TECHNICAL FIELD

The present application relates to an image forming apparatus, which forms images on sheets, and a processing apparatus which carries out prescribed processes.

BACKGROUND

In general, a mechanical apparatus has a housing which stores parts or assembly configured to carry out image formation or other processes. In many cases, an opening is formed on the housing to install equipment inside the housing, or repair or replace equipment situated inside the housing. In terms of user safety, a cover for covering the opening on the housing is attached to the housing.

If equipment inside the housing is connected to a drive source, such as a motor, the equipment inside the housing has to be mechanically disconnected from the drive source in order to take out the equipment from the housing. If the equipment inside the housing is mechanically disconnected from the drive source in coordination with covering and uncovering operation of a cover, maintenance and replacement processes become efficient. A link mechanism that mechanically disconnects the equipment inside the housing from the drive source in coordination with the covering and uncovering operation of the cover may make the aforementioned process more efficient.

A conventional link mechanism is subjected to constraints on an angular range for the covering and uncovering operation of the cover and a positional relationship between the cover and the link mechanism. Consequently, in many cases, principles of the conventional link mechanism may not be available because of designs of equipment to be connected to the cover via the link mechanism.

It is an object of the present disclosure to provide an image forming apparatus and a processing apparatus having a link mechanism which is subjected to few constraints on an internal structure of the housing.

SUMMARY

The image forming apparatus according to one aspect of the present disclosure includes: a housing including a rotatable cover member configured to cover and uncover an opening in communication with an internal space in which the image forming portion is situated; a drive portion which generates a drive force to drive the image forming portion; and a clutch mechanism configured to intermittently transmit the drive force from the drive portion to the image forming portion. The clutch mechanism includes: a transmission member with a first transmission portion, which receives the drive force from the drive portion, and a second transmission portion, which engages with the image forming portion; a link mechanism configured to reciprocate the transmission member in a first direction, in which the transmission member moves away from the image forming portion, and a second direction opposite to the first direction; and a flexible linker configured to link the cover member with the link mechanism. The link mechanism coordinating with the cover member by means of the linker when the cover member uncovers the opening moves the transmission member in the first direction. The link mechanism coordinating with the cover member by means of the linker when the cover member covers the opening moves the transmission member in the second direction.

The processing apparatus according to another aspect of the present disclosure includes: a housing including a rotatable cover member configured to cover and uncover an opening in communication with an internal space in which the processing portion is stored; a drive portion which generates a drive force to drive the processing portion; and a clutch mechanism configured to intermittently transmit the drive force from the drive portion to the processing portion. The clutch mechanism includes: a transmission member with a first transmission portion, which receives the drive force from the drive portion, and a second transmission portion, which engages with the processing portion; a link mechanism configured to reciprocate the transmission member in a first direction, in which the transmission member moves away from the processing portion, and a second direction opposite to the first direction; and a flexible linker configured to link the cover member to the link mechanism. The link mechanism moves the transmission member in the first direction when the cover member uncovers the opening. The link mechanism moves the transmission member in the second direction when the cover member covers the opening.

The object, features and advantages of the present teachings will become more apparent based on the ensuing detailed description and appended drawings.

BRIEF DESCRIPTION OF THE DRAWINGS

The figures depict one or more implementations in accord with the present teachings, by way of example only, not by way of limitations. In the figures, like reference numerals refer to the same or similar elements.

DETAILED DESCRIPTION

In the following detailed description, numerous specific details are set forth by way of examples in order to provide a thorough understanding of the relevant teaching. However it should be apparent to those skilled in the art that the present teachings may be practiced without exemplary details. In other instances, well known methods, procedures, components, and/or circuitry have been described at a relatively high-level, without detail, in order to avoid unnecessary obscuring aspects of the present concepts.

In exchange for the present disclosure herein, the Applicants desire all patent rights described in the claims. Therefore, the patent rights are not intended to be limited or restricted by the following detailed description and accompanying figures.

The image forming apparatus is described with reference to the accompanying drawings. The terms indicating the directions "up", "down", "left" and "right" used in the following description are simply intended to clarify the explanation, and do not in any way limit the principles of the image forming apparatus.

General Structure

Figure 1:
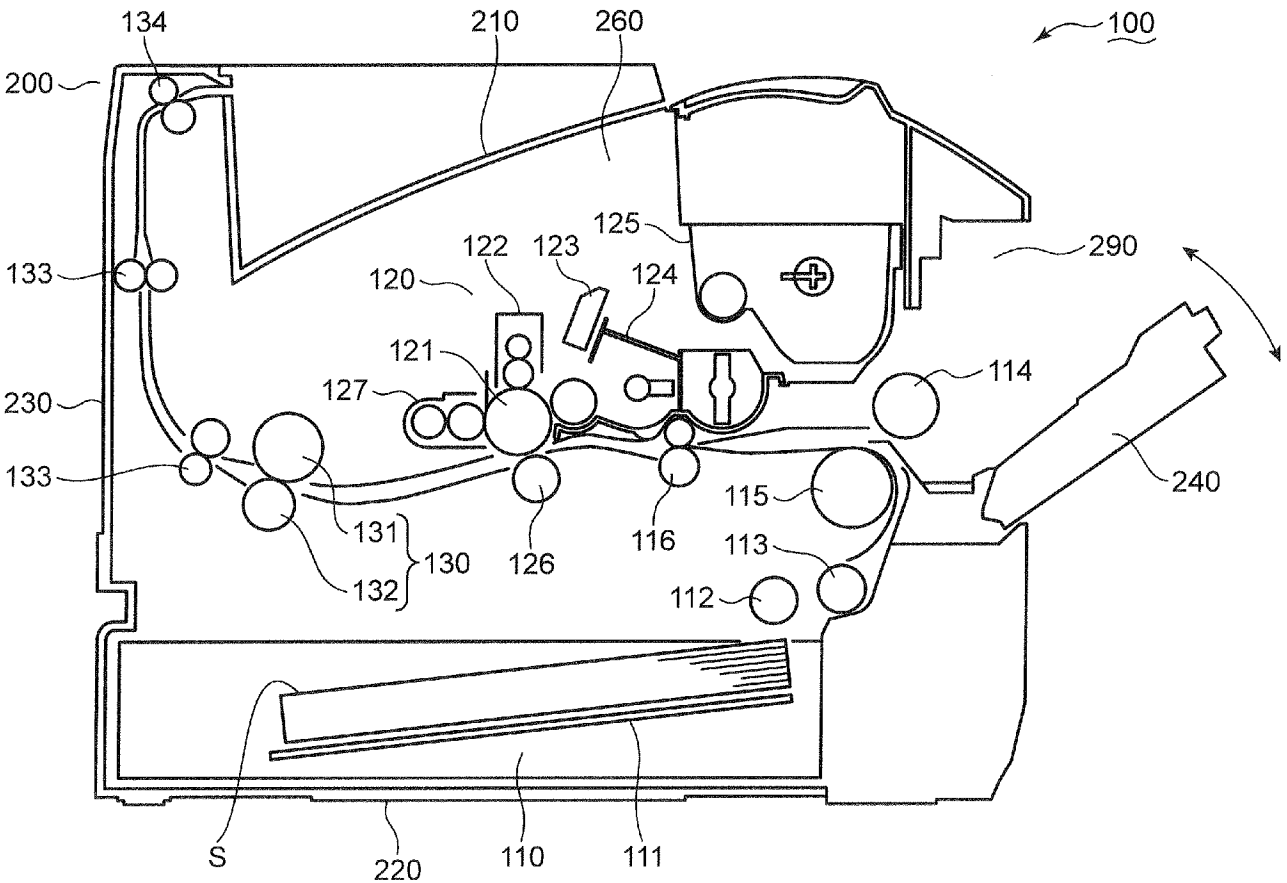
FIG. 1 is a schematic view of a printer exemplified as the image forming apparatus.

FIG. 1 is a schematic view of the printer 100 exemplified as the image forming apparatus. The printer 100 is described with reference to FIG. 1. Copying machines or other apparatuses configured to form images on sheets may be used as the image forming apparatus.

The printer 100 includes a housing 200 which stores various components configured to form an image on a sheet S. The housing 200 includes an upper wall 210, which forms an upper surface of the housing 200, a bottom wall 220, which forms a bottom surface of the housing 200, an upright rear wall 230 between the upper and bottom walls 210, 220, and a manual tray 240 opposite to the rear wall 230. The manual tray 240 may be vertically rotated. As shown in FIG. 1, when the manual tray 240 is rotated downwards, an opening 290 formed on the housing 200 is uncovered. The opening 290 is in communication with an internal space 260 of the housing 200. Consequently, a user may access various components stored in the internal space 260 of the housing 200 through the opening 290. When the manual tray 240 rotates upwards, the opening 290 is covered to prevent the user from unnecessarily accessing the internal space 260. In the present embodiment, the manual tray 240 is exemplified as the cover member. Alternatively, other parts for covering and uncovering an opening formed on the housing may be used as the cover member.

The printer 100 further includes a cassette 110 configured to store sheets S. The cassette 110 includes a lift plate 111 configured to support the sheets S. The lift plate 111 is inclined so as to push up the leading edge of the sheets S.

The printer 100 also includes a pick-up roller 112 on the leading edge of the sheets S pushed up by the lift plate 111. When the pick-up roller 112 rotates, one of the sheets S is pulled out from the cassette 110.

The printer 100 also includes a feed roller 113 which is arranged to the downstream side of the pick-up roller 112. The feed roller 113 sends the sheet S further downstream.

The user may place a sheet S on the aforementioned manual tray 240. The printer 100 also includes a feed roller 114 which pulls the sheet S on the manual tray 240 into the housing 200.

The printer 100 also includes a conveyance roller 115 arranged on the downstream side of the feed rollers 113, 114. The conveyance roller 115 conveys a sheet S sent by the feed rollers 113, 114 further downstream.

The printer 100 also includes a resist roller pair 116, which adjusts a position of an image formed on a sheet S, and an image forming portion 120 which forms the image on the sheet S. The resist roller pair 116 feeds the sheet S to the image forming portion 120 in synchronism with image formation timing by the image forming portion 120.

The image forming portion 120 includes a substantially cylindrical photosensitive drum 121 and a charger 122 which substantially uniformly charges the circumferential surface of the photosensitive drum 121. The image forming portion 120 also includes an exposure apparatus 123 which irradiates laser light onto the circumferential surface of the photosensitive drum 121 charged by the charger 122. The exposure apparatus 123 irradiates laser light in response to image data output from an external apparatus (not shown) such as a personal computer which is communicably connected to the printer 100. Consequently, an electrostatic latent image corresponding to the image data is formed on the circumferential surface of the photosensitive drum 121.

The image forming portion 120 also includes a developing apparatus 124 configured to supply toner to the circumferential surface of the photosensitive drum 121, on which the electrostatic latent image is formed, and a toner container 125 configured to supply toner to the developing apparatus 124. The toner container 125 supplies toner to the developing apparatus 124 sequentially or as appropriate. The electrostatic latent image formed on the circumferential surface of the photosensitive drum 121 is developed (visualized) when the developing apparatus 124 supplies toner to the photosensitive drum 121. Therefore, a toner image is formed on the circumferential surface of the photosensitive drum 121.

The image forming portion 120 also includes a transfer roller 126 configured to press against the circumferential surface of the photosensitive drum 121. The resist roller pair 116 sends a sheet S in between the photosensitive drum 121 and the transfer roller 126. While the sheet S passes between the photosensitive drum 121 and the transfer roller 126, the toner image formed on the circumferential surface of the photosensitive drum 121 is transferred onto the sheet S.

The image forming portion 120 also includes a cleaning apparatus 127 configured to remove toner remaining on the circumferential surface of the photosensitive drum 121 after the transfer of the toner image to the sheet S. The circumferential surface of the photosensitive drum 121 cleaned by the cleaning apparatus 127 passes again below the charger 122 and is charged uniformly. Therefore, the aforementioned toner image formation is newly carried out.

The printer 100 also includes a fixing apparatus 130 configured to fix the toner image onto the sheet S. The fixing apparatus 130 includes a heating roller 131, which melts toner on the sheet S, and the pressure roller 132, which pushes the sheet S onto the heating roller 131. While the sheet S passes between the heating roller 131 and the pressure roller 132, the toner image is fixed to the sheet S.

The printer 100 also includes several conveyance roller pairs 133, which are arranged to the downstream side of the fixing apparatus 130, and a discharge roller pair 134, which is arranged to the downstream side of the conveyance roller pair 133. The sheet S is conveyed upwards by the conveyance roller pair 133, and eventually, discharged from the housing 200 by the discharge roller pair 134. The sheet S discharged from the housing 200 is stacked on the upper wall 210.

The aforementioned structure of the printer 100 is exemplary. A printer having other structures may be used as the image forming apparatus.

Housing

Figure 2:
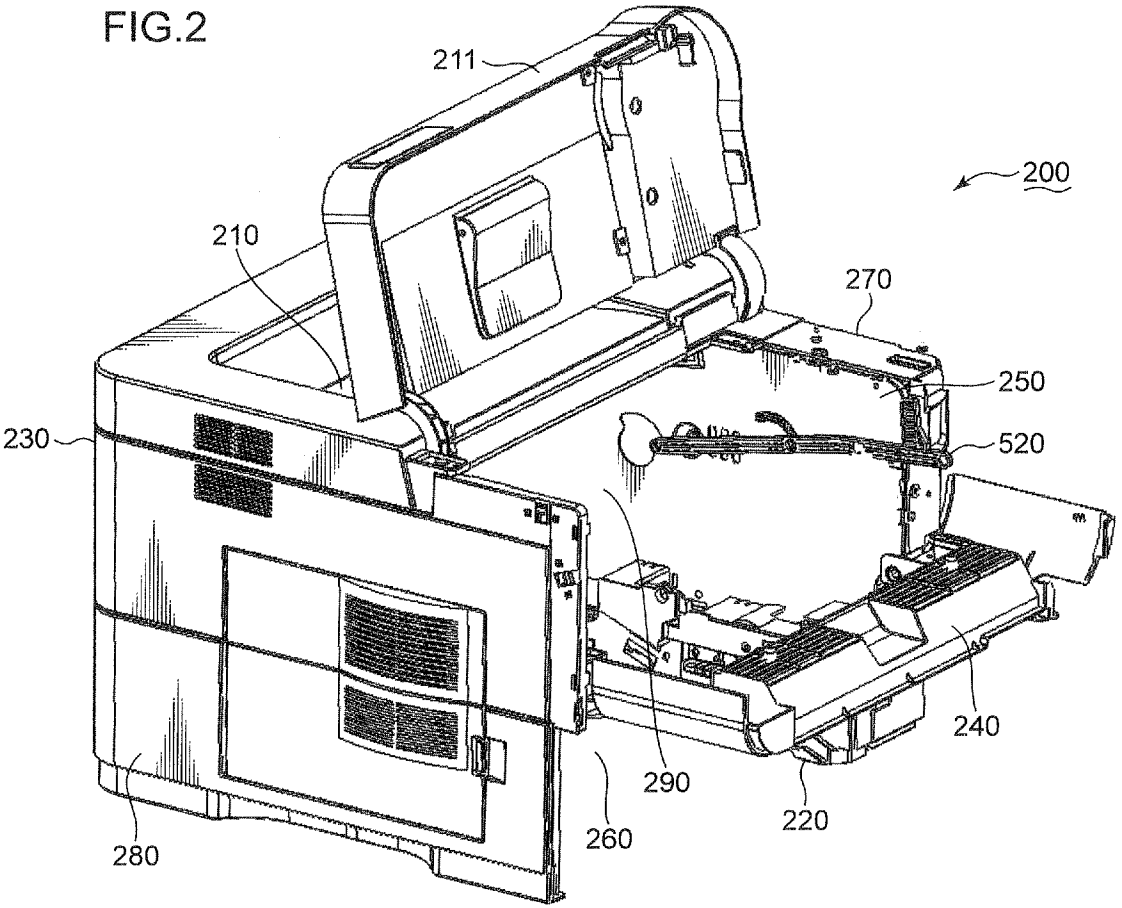
FIG. 2 is a schematic perspective view of a housing of the printer shown in FIG. 1.

FIG. 2 is a schematic perspective view of the housing 200. The housing 200 is described with reference to FIGS. 1 and 2.

In addition to the upper, bottom and rear walls 210, 220, 230 and the manual tray 240, the housing 200 includes an internal wall 250 which is orthogonal to the upper and rear walls 210, 230. The inner wall 250 is used to support various apparatuses (e.g., the image forming portion 120) which are arranged inside the internal space 260.

The housing 200 also includes a left wall 280, which is orthogonal to the upper and rear walls 210, 230, and a right wall 270 opposite to the left wall 280. The drive equipment for driving various apparatuses (e.g., the image forming portion 120) arranged in the internal space 260 is situated between the inner and right walls 250, 270. The rotatable manual tray 240 is attached to the right and left walls 270, 280.

The upper wall 210 includes an upper cover 211 which vertically rotates above the manual tray 240. A user may rotate the upper cover upwards to easily access the toner container 125.

Drive Structure

Figure 3:
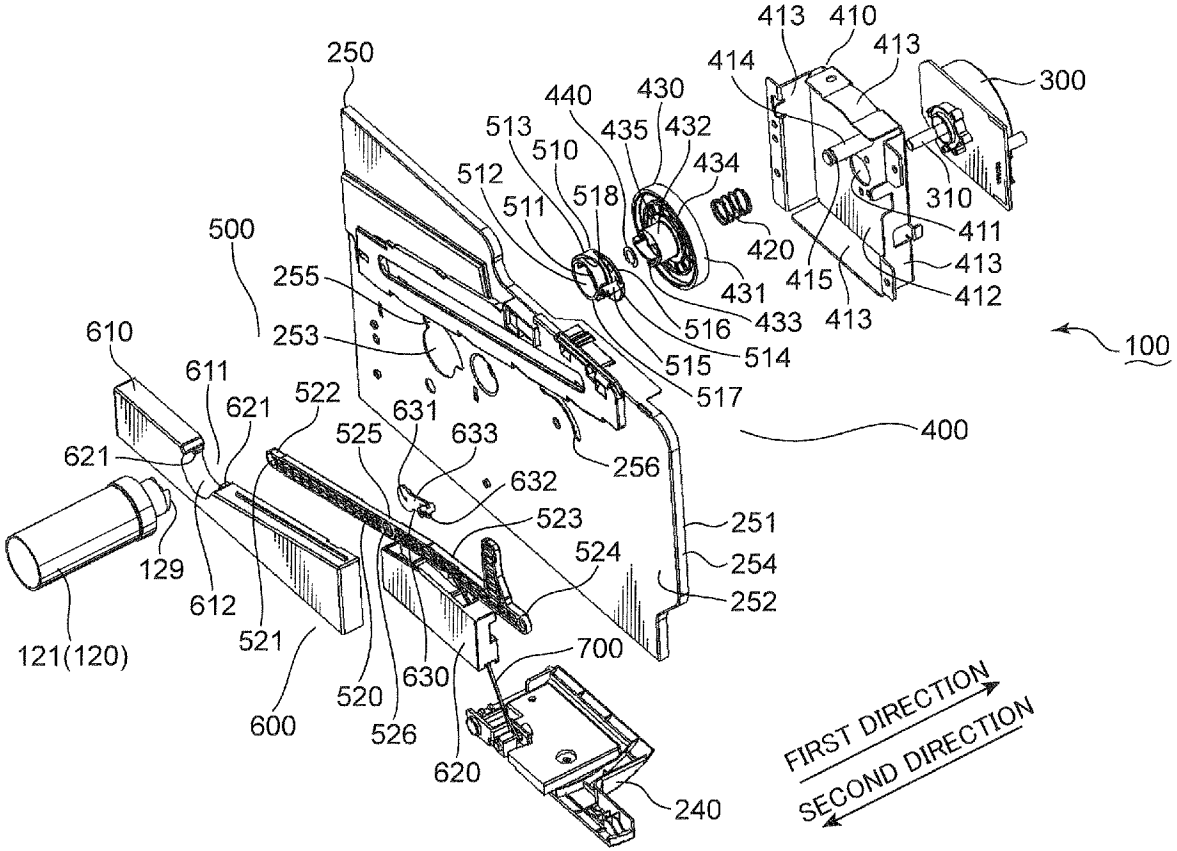
FIG. 3 is a schematic perspective view of a drive structure configured to drive a photosensitive drum of the printer shown in FIG. 1.

FIG. 3 is a schematic perspective view of a drive structure configured to drive the photosensitive drum 121. The drive structure for the photosensitive drum 121 is described with reference to FIGS. 1 and 3.

The printer 100 also includes a drive motor 300, which generates a drive force for driving the photosensitive drum 121 of the image forming portion 120, and a clutch mechanism 400, which intermittently transmits the drive force from the drive motor 300 to the photosensitive drum 121. The aforementioned inner wall 250 is used as a part of the clutch mechanism 400. The inner wall 250 includes a first surface 251, which faces the drive motor 300, and a second surface 252, which faces the photosensitive drum 121.

The clutch mechanism 400 includes a substantially rectangular box-shaped cover case 410 configured to support the drive motor 300. The drive motor 300 includes a rotational shaft 310 which projects towards the first surface 251. The cover case 410 includes a supporting plate 412 provided with an opening 411, into which the rotational shaft 310 is inserted, and peripheral plates 413, which are bent towards the first surface 251 from peripheral edges of the supporting plate 412. A space is defined between the first surface 251 and the supporting plate 412 by the peripheral plate 413.

The cover case 410 also includes a supporting pin 414 which projects towards the first surface 251 from the supporting plate 412. The supporting pin 414 supports various parts of the clutch mechanism 400 in the space defined between the first surface 251 and the supporting plate 412.

Figure 4:
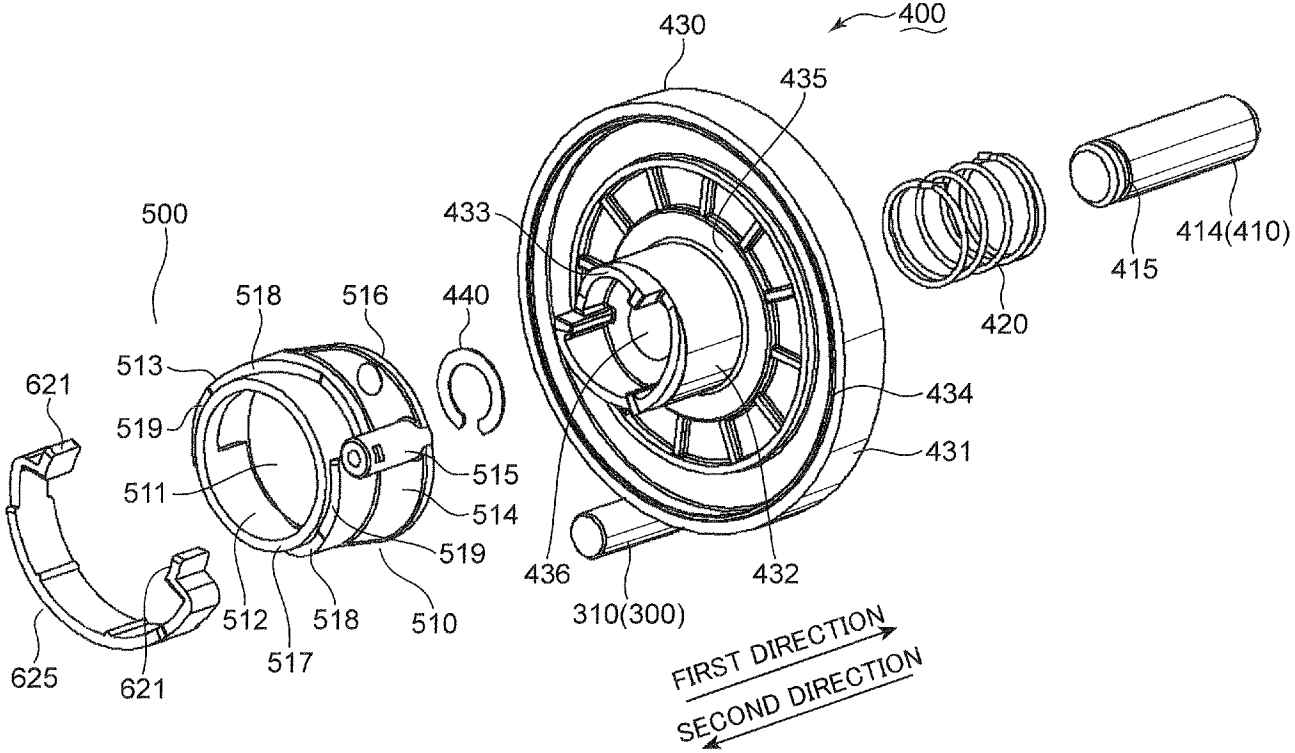
FIG. 4 is a schematic exploded perspective view of a clutch mechanism of the printer shown in FIG. 1.

FIG. 4 is a schematic exploded perspective view of the clutch mechanism 400. The clutch mechanism 400 is described with reference to FIGS. 3 and 4.

FIG. 4 shows the supporting pin 414 of the cover case 410 and the rotational shaft 310 of the drive motor 300, which are described with reference to FIG. 3. Gear teeth are formed on the rotational shaft 310. The clutch mechanism 400 has a coil spring 420, into which the supporting pin 414 is inserted, and a transmission gear 430, which engages with the rotational shaft 310. When the clutch mechanism 400 is assembled, the coil spring 420 is compressed between the transmission gear 430 and the supporting plate 412. Consequently, the coil spring 420 biases the transmission gear 430 toward the first surface 251 (i.e., a direction towards the photosensitive drum 121). In the following description, the direction away from the first surface 251 (i.e., the direction away from the photosensitive drum 121) is called "first direction". The opposite direction to the first direction (i.e., the direction towards the first surface 251 and the photosensitive drum 121) is called "second direction". In the present embodiment, the coil spring 420 is exemplified as the bias member. Alternatively, other parts configured to bias the transmission gear or other parts for transmitting a drive force in the second direction may be used as the bias member.

The transmission gear 430 includes a gear ring 431, which engages with the rotational shaft 310 to receive a drive force, a flange 435, which supports the gear ring 431, and a shaft portion 432, which projects towards the first surface 251 (i.e., the photosensitive drum 121) from the flange 435. The shaft portion 432 includes a distal end 433 which is profiled in a saw blade shape. A proximal end 129 of the photosensitive drum 121 is also profiled into a saw blade shape (see FIG. 3) to be complementary with the distal end 433 of the shaft portion 432. The distal end 433 of the shaft portion 432 abuts to the proximal end 129 of the photosensitive drum 121. Consequently, the distal end 433 of the shaft portion 432 and the proximal end 129 of the photosensitive drum 121 engage with each other to form a coupling structure. An axial bore 436 passing through the flange 435 and the shaft portion 432 is formed at the center of the gear ring 431. The rotatable transmission gear 430 is supported by the supporting pin 414 passing through the axial bore 436. Therefore, the drive force from the drive motor 300 is transmitted appropriately to the photosensitive drum 121. In the present embodiment, the distal end 433 of the shaft portion 432 is exemplified as the engaging end.

When the rotational shaft 310 of the drive motor 300 rotates, the gear ring 431 engaging with the rotational shaft 310 rotates. Due to the rotation of the gear ring 431, the shaft portion 432 also rotates. Consequently, the photosensitive drum 121 engaging with the distal end 433 of the shaft portion 432 also rotates. In the present embodiment, the transmission gear 430 is exemplified as the transmission member. Alternatively, other parts (e.g., pulleys) configured to transmit a drive force from a drive source such as a motor to the image forming portion may be used as the transmission member.

In the present embodiment, the gear ring 431 is exemplified as the first transmission portion. The shaft portion 432 is exemplified as the second transmission shaft or engagement shaft.

The clutch mechanism 400 also includes a C-shaped washer 440. A groove 415, into which the washer 440 is fitted, is formed on the tip of the supporting pin 414. When the washer 440 is fitted into the groove 415 after insertion of the supporting pin 414 into the coil spring 420 and the transmission gear 430, the transmission gear 430 is held between the washer 440 and the supporting plate 412 of the cover case 410.

The gear ring 431 includes an annular rib 434 projecting towards the first surface 251 which faces the transmission gear 430. The rib 434 approaches the first surface 251 while the engagement between the transmission gear 430 and the photosensitive drum 121 is maintained. As shown in FIG. 3, the clutch mechanism 400 also includes a link mechanism 500 which reciprocates the transmission gear 430 in the first and second directions. The aforementioned coil spring 420 is used as a part of the link mechanism 500 and serves to move the transmission gear 430 in the first direction.

As shown in FIG. 4, the link mechanism 500 includes a clutch ring 510 which principally serves to move the transmission gear 430 in the first direction. The clutch ring 510 includes an inner surface 512 which defines a substantially circular insertion bore 511, into which the shaft portion 432 of the transmission gear 430 is inserted, and an outer surface 513 opposite to the inner surface 512. The clutch ring 510 is independent from rotation of the shaft portion 432 inserted into the insertion bore 511.

The clutch ring 510 also includes a tongue plate 514, which projects from the substantially cylindrical outer surface 513 in a radial direction, and a first connecting pin 515, which projects from the tongue plate 514 to the photosensitive drum 121. Operation of the link mechanism 500, which is described below, is converted into rotation of the clutch ring 510 via the first connecting pin 515. When the clutch ring 510 is rotated around the insertion bore 511 so that the first connecting pin 515 is moved in one direction, the clutch ring 510 is displaced in the first direction. When the first connecting pin 515 is rotated around the insertion bore 511 in another direction, the clutch ring 510 is displaced in the second direction by the coil spring 420. In the following description, the rotational direction of the clutch ring 510 when the clutch ring 510 is displaced in the first direction is called "first rotational direction". The rotational direction of the clutch ring 510 when the clutch ring 510 is displaced in the second direction is called "second rotational direction". The displacement of the clutch ring 510 in the first and second directions is described below.

The clutch ring 510 also includes a projecting surface 516 which outwardly extends in a radial direction from the insertion bore 511 and faces the transmission gear 430. The end beside the transmission gear 430 and the projecting surface 516 of the clutch ring 510 hit a part of the flange 435 of the transmission gear 430. When the clutch ring 510 rotates in the first rotational direction, as described above, the clutch ring 510 is displaced in the first direction to push the transmission gear 430 in the first direction.

Figure 5:
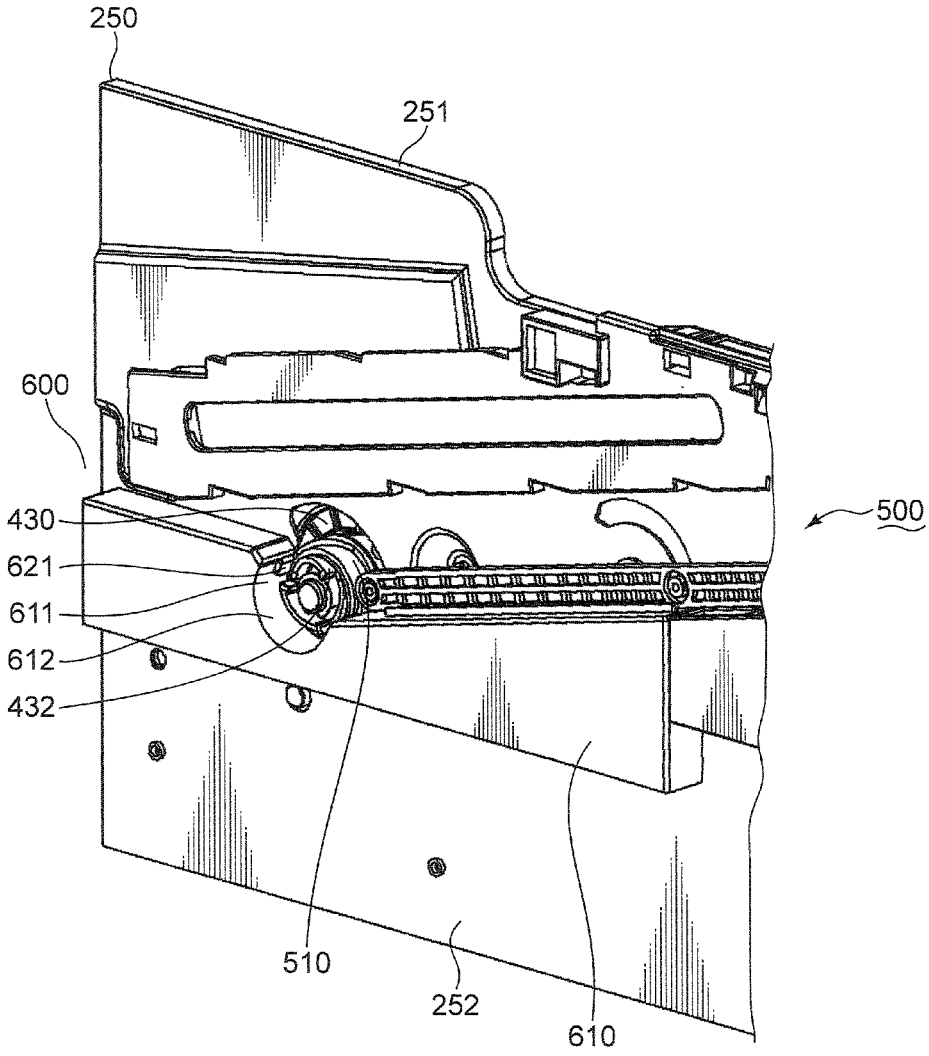
FIG. 5 is a schematic perspective view of a clutch ring mounted on an inner wall of the printer shown in FIG. 1.

FIG. 5 is a schematic perspective view of the clutch ring 510 mounted on the inner wall 250. The clutch mechanism 400 is further described with reference to FIGS. 3 to 5.

The link mechanism 500 also includes a supporting structure 600 configured to support the clutch ring 510. The aforementioned inner wall 250 is used as a part of the supporting structure 600. As shown in FIG. 3, a through hole 253 is formed on the inner wall 250. As shown in FIG. 5, the clutch ring 510, into which the shaft portion 432 of the transmission gear 430 is inserted, projects from the second surface 252 through the through hole 253.

In addition to the inner wall 250, the supporting structure 600 includes a supporting block 610 which is fixed to the second surface 252 of the inner wall 250. The supporting block 610 includes a substantially C-shaped notch surface 612 defining a notch 611 in which the clutch ring 510 is stored. The notch surface 612 supports the clutch ring 510. The clutch ring 510 in the aforementioned first and second rotational directions is rotated within the notch 611. The coupling structure between the photosensitive drum 121 and the transmission gear 430 is also formed inside the notch 611.

As shown in FIG. 4, the supporting structure 600 also includes a C-shaped ring 625. The C-shaped ring 625 is a C-shaped plate, which includes a pair of hooks 621 at both ends. The hooks 621 are bent inwards at the ends of the C-shaped ring 625. Slit openings (not shown), which are as wide as a thickness of the C-shaped ring 625, are formed near each end of the notch surface 612 in the circumferential direction. When the C-shaped ring 625 is fitted into the supporting block 610 so as to wrap about the notch surface 612 from the bottom, the hooks 621 pass through the slit openings formed on the notch surface 612 and project from the notch surface 612.

Figure 6A:
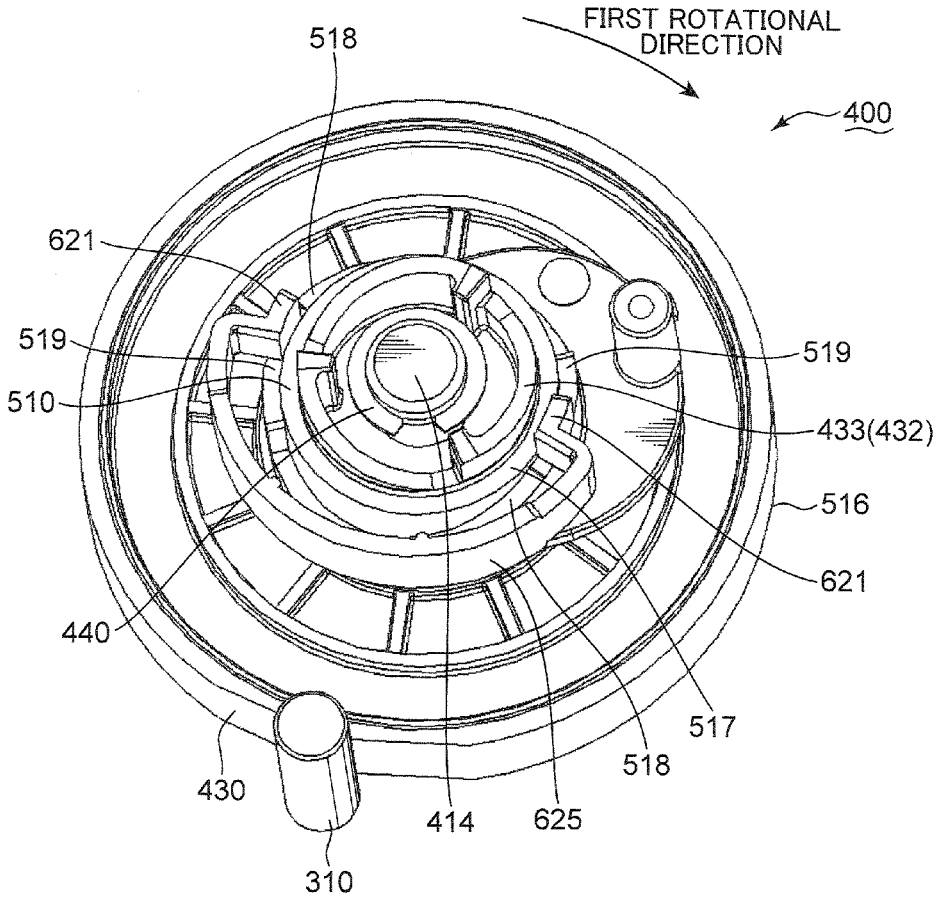
FIG. 6A is a schematic perspective view of a clutch mechanism with the clutch ring shown in FIG. 5.
Figure 6B:
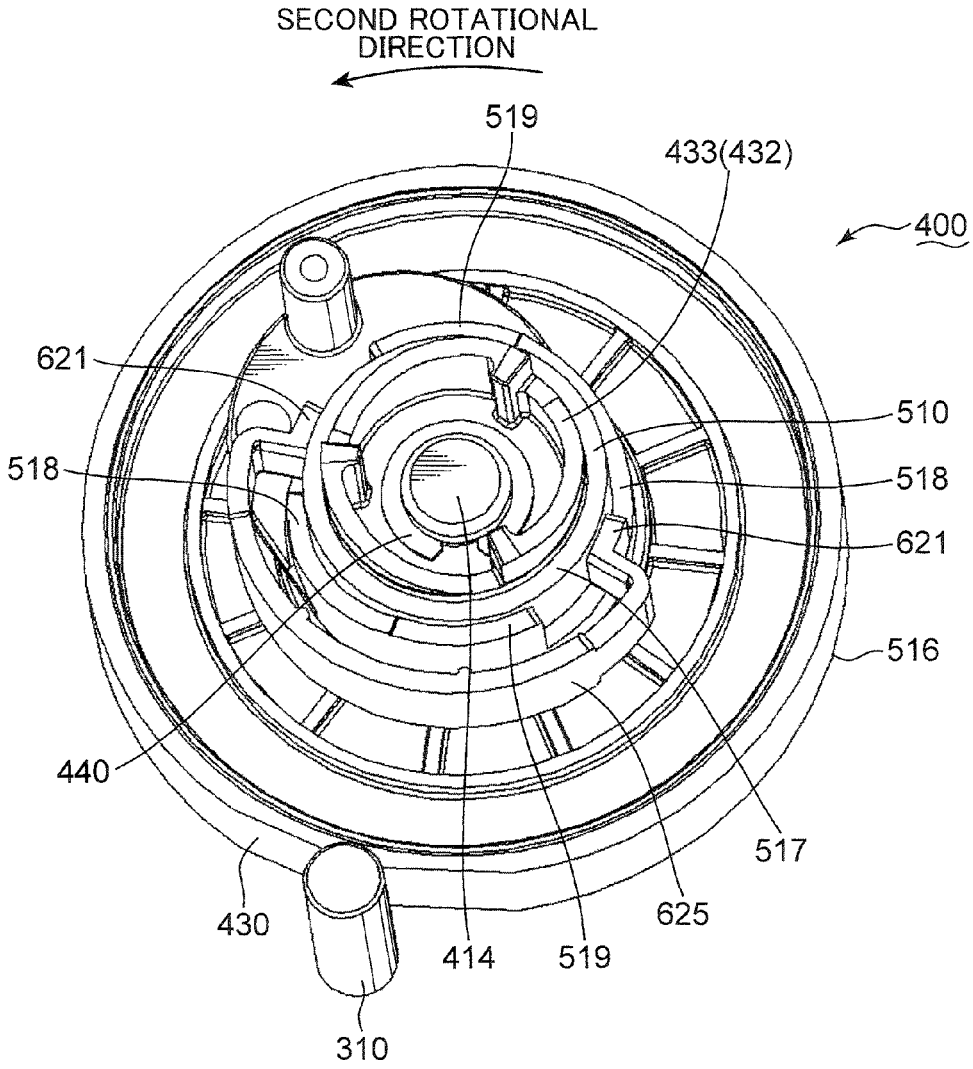
FIG. 6B is a schematic perspective view of a clutch mechanism with the clutch ring shown in FIG. 5.

FIG. 6A is a schematic perspective view of the clutch mechanism 400 with the clutch ring 510 which rotates in the first rotational direction. FIG. 6B is a schematic perspective view of the clutch mechanism 400 with the clutch ring 510 which rotates in the second rotational direction. A relationship between the clutch ring 510 and the hooks 621 of the C-shaped ring 625 is described with reference to FIGS. 3, 4, 6A and 6B.

The clutch ring 510 also includes a facing end 517 which faces the photosensitive drum 121. The distal end 433 of the shaft portion 432 of the transmission gear 430 projects from the facing end 517. Consequently, the distal end 433 is engaged with the proximal end 129 of the photosensitive drum 121.

The outer surface 513 of the clutch ring 510 includes a pair of inclination surfaces 518 which extends in a circumferential direction. The inclination surfaces 518 approach the projecting surface 516 from the facing end 517. An inclination direction of the inclination surfaces 518 is designed so that the clutch ring 510 rotating in the first rotational direction is displaced in the first direction. The paired inclination surfaces 518 correspond to the paired hooks 621.

Flat surfaces 519, which are the most closest to the photosensitive drum 121, are formed between the paired inclination surfaces 518. As shown in FIG. 6A, when the clutch ring 510 is rotated in the first rotational direction, the hooks 621 ride up on the flat surfaces 519. As shown in FIG. 6B, when the clutch ring 510 is rotated in the second rotational direction, the hooks 621 slide over the inclination surfaces 518.

As described above, the C-shaped ring 625 with the hooks 621 is fixed to the supporting block 610. Therefore, the C-shaped ring 625 is immobile on the supporting block 610. On the other hand, the clutch ring 510 may be displaced in the first and second directions in response to compression and extension of the coil spring 420. Consequently, the hooks 621 slide over the inclination surfaces 518 toward the flat surfaces 519 to push the clutch ring 510 in the first direction when the clutch ring 510 is rotated in the first rotational direction. The clutch ring 510 pushed in the first direction then pushes the transmission gear 430 in the first direction. Consequently, the shaft portion 432 of the transmission gear 430 moves away from the proximal end 129 of the photosensitive drum 121. Therefore, the transmission gear 430 is disengaged from the photosensitive drum 121.

When the clutch ring 510 rotates in the second rotational direction, the hooks 621 pass from the flat surfaces 519 to the inclination surfaces 518. As a result of the aforementioned displacement of the clutch ring 510 in the first direction, the coil spring 420 is compressed so that the coil spring 420 pushes the transmission gear 430 and the clutch ring 510 in the second direction. Consequently, when the hooks 621 slide over the inclination surfaces 518, the clutch ring 510 rotated in the second rotational direction is displaced in the second direction together with the transmission gear 430.

Figure 7A:
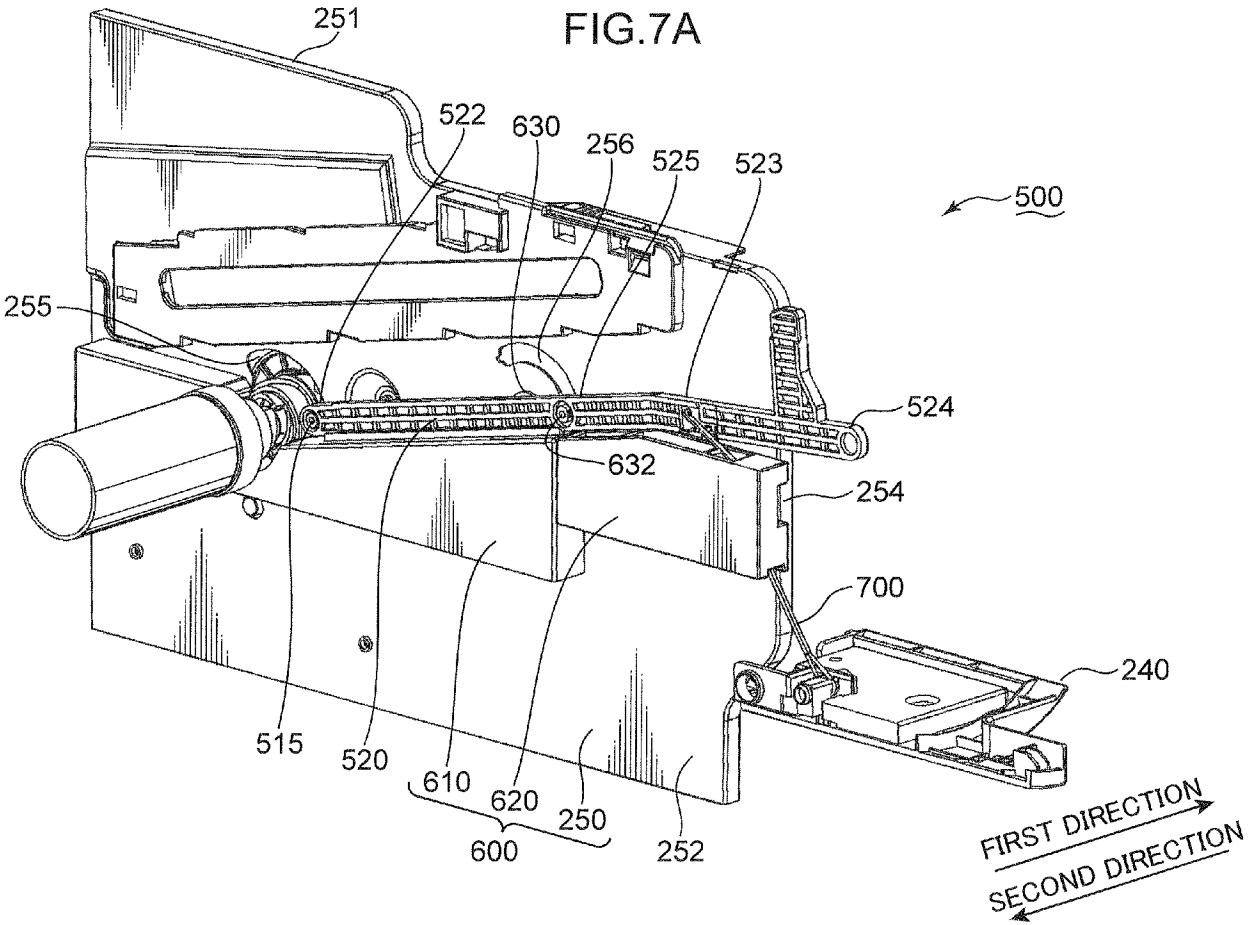
FIG. 7A is a schematic perspective view of a link mechanism of the drive structure shown in FIG. 3. The manual tray is situated so that the manual tray uncovers an opening on the housing.
Figure 7B:
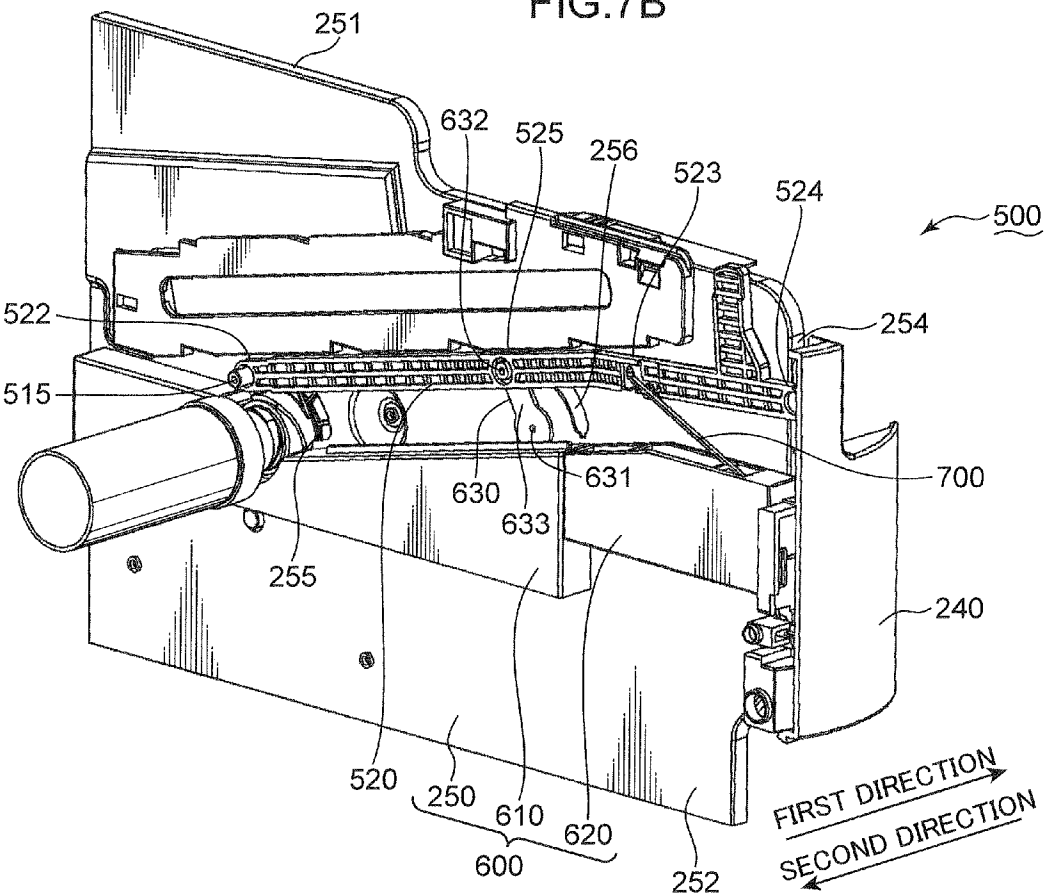
FIG. 7B is a schematic perspective view of the link mechanism of the drive structure shown in FIG. 3. The manual tray is situated so that the manual tray covers the opening on the housing.

FIGS. 7A and 7B show schematic perspective views of the link mechanism 500. The link mechanism 500 is further described with reference to FIGS. 2 to 4 and FIGS. 7A and 7B.

FIGS. 3, 7A and 7B show a part of the manual tray 240. The manual tray 240 shown in FIGS. 3 and 7A is situated to uncover the opening 290 (c.f., FIG. 2) of the housing 200. The manual tray 240 shown in FIG. 7B is situated to cover the opening 290 of the housing 200.

The link mechanism 500 also includes a substantially L-shaped arm 520. The arm 520 includes a first connecting portion 522 provided with a first connecting hole 521, into which the first connecting pin 515 of the clutch ring 510 is inserted. The first connecting pin 515 of the clutch ring 510 is inserted into the first connecting hole 521. As shown in FIGS. 7A and 7B, the first connecting hole 521 may allow reciprocation of the first connecting pin 515 in the first and second directions.

As shown in FIG. 7B, the arm 520 extends from the first connecting portion 522 towards the manual tray 240 which covers the opening 290 of the housing 200. As shown in FIG. 3, the clutch mechanism 400 also includes a flexible wire 700 which connects the manual tray 240 to the arm 520. In the present embodiment, the wire 700 is exemplified as the linker. Alternatively, other flexible members configured to connect the cover member to the link mechanism may be used as the linker.

Figure 8:
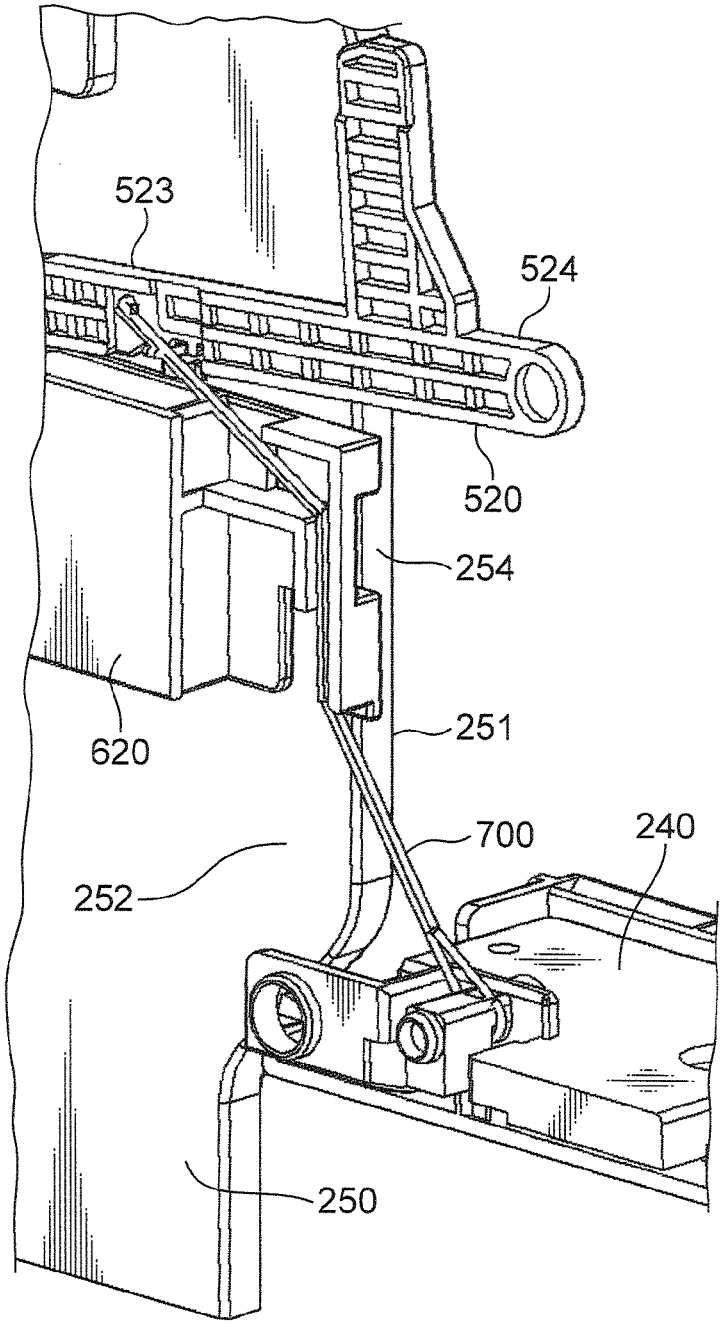
FIG. 8 is a schematic perspective view of a binding structure between an arm and a wire of the link mechanism shown in FIGS. 7A and 7B.

FIG. 8 is a schematic perspective view of a binding structure between the arm 520 and the wire 700. The binding structure between the arm 520 and the wire 700 are described with reference to FIGS. 2 to 4 and FIGS. 7A to 8.

The arm 520 includes a second connecting portion 523 to which the wire 700 is connected. Both ends of the wire 700 are appropriately bound to the second connecting portion 523 of the arm 520 and the manual tray 240, respectively. As shown in FIG. 7B, the arm 520 also includes a tip 524 which is situated nearby the manual tray 240 covering the opening 290 of the housing 200.

Figure 9A:
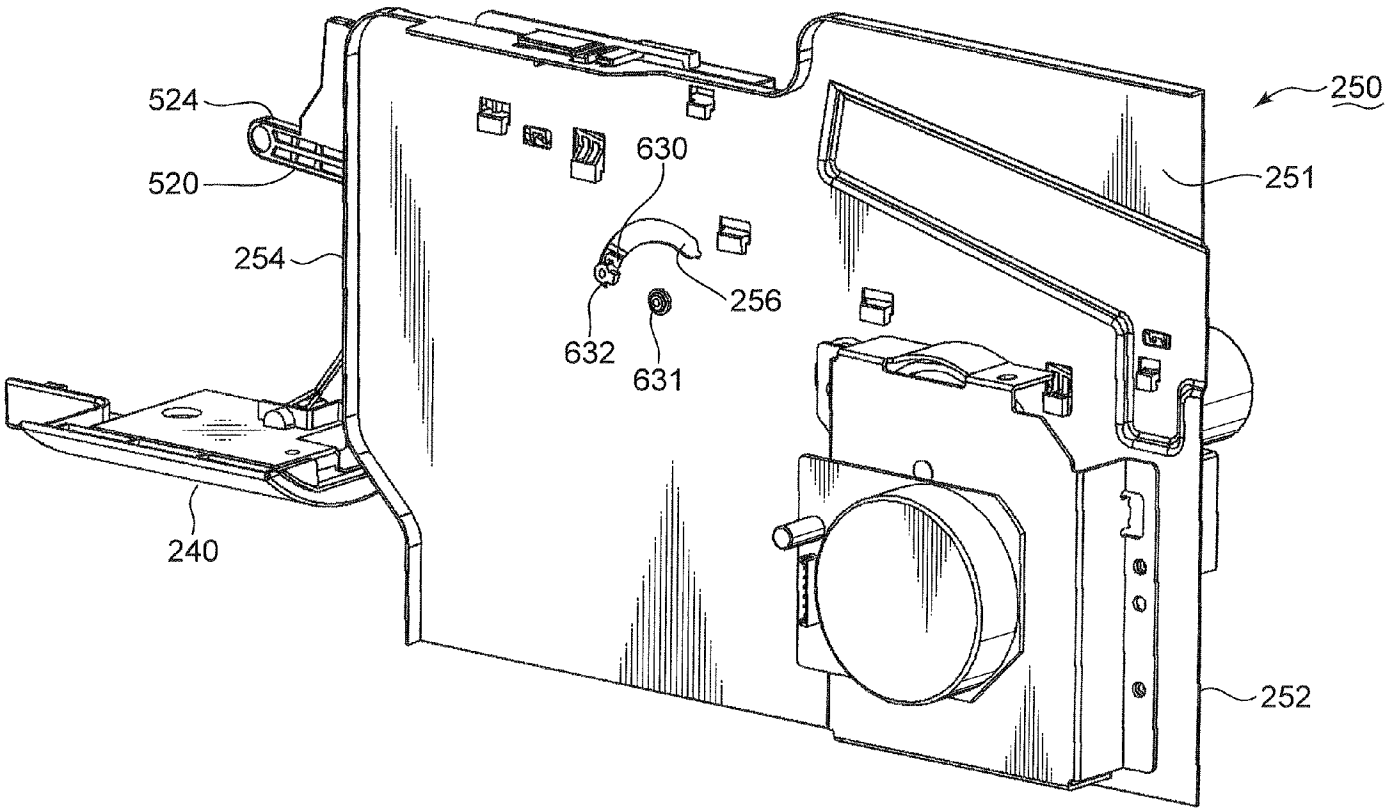
FIG. 9A is a schematic perspective view of a first surface of the inner wall shown in FIG. 5.
Figure 9B:
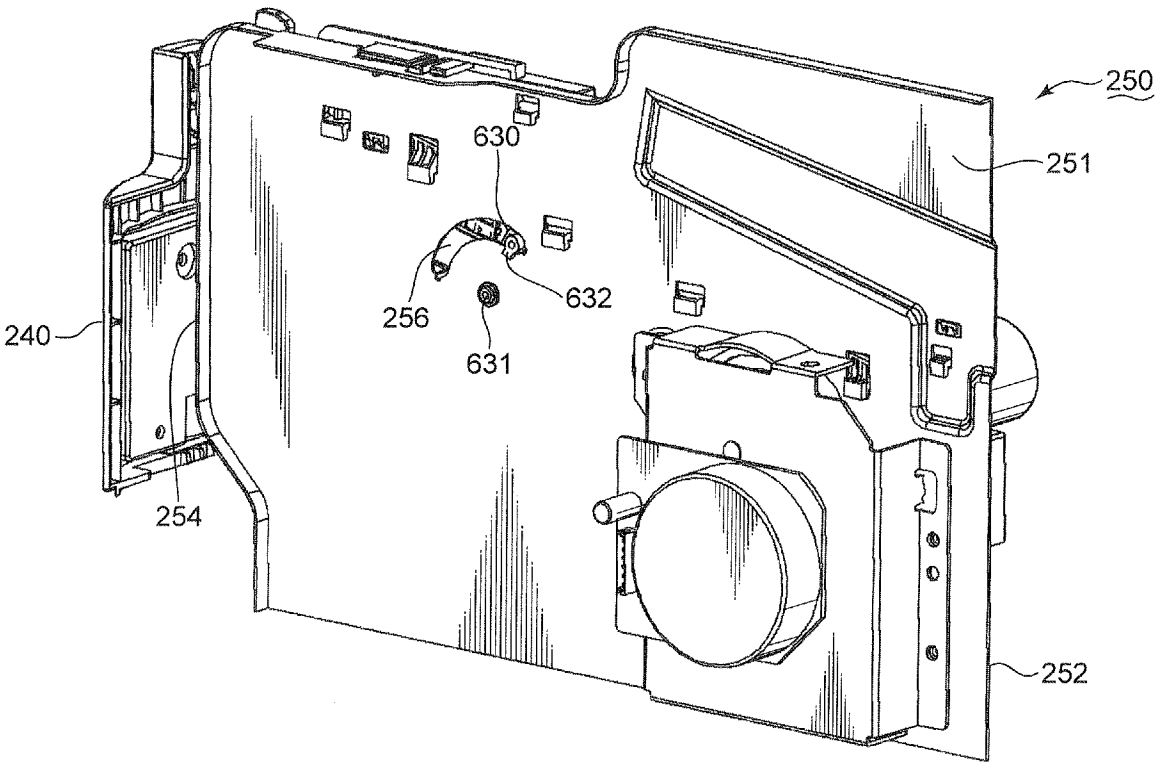
FIG. 9B is a schematic perspective view of a first surface of the inner wall shown in FIG. 5.

FIGS. 9A and 9B are schematic perspective views of the first surface 251 of the inner wall 250. A relationship between the manual tray 240 and the arm 520 is described with reference to FIGS. 2, 7A to 9B. The manual tray 240 shown in FIG. 9A is situated to uncover the opening 290 (c.f., FIG. 2) of the housing 200. The manual tray 240 shown in FIG. 9B is situated to cover the opening 290 of the housing 200.

The inner wall 250 includes a front edge 254 which is situated nearby the manual tray 240 covering the opening 290 of the housing 200. Consequently, projection of the tip 524 of the arm 520 beyond the front edge 254 means that the arm 520 projects beyond the housing 200 through the opening 290 of the housing 200.

As shown in FIGS. 7A and 9A, when the manual tray 240 uncovers the opening 290 of the housing 200, the tip 524 of the arm 520 projects from the housing 200 through the opening 290. Consequently, when the manual tray 240 is rotated so as to cover the opening 290, the manual tray 240 hits the tip 524 of the arm 520. Accordingly, the arm 520 is pushed and displaced into the internal space 260 of the housing 200 (c.f., FIG. 2).

In addition to the inner wall 250 and the supporting block 610, the supporting structure 600 includes a protecting block 620 into which the wire 700 is inserted. The protecting block 620 is fixed to the second surface 252 of the inner wall 250. When the manual tray 240 is rotated upwards, the wire 700 slackens temporarily. The protecting block 620 prevents the slackened wire 700 from entangling with other parts of the printer 100.

When the manual tray 240 hits the tip 524 of the arm 520 to push the arm 520 into the internal space 260 of the housing 200, there may be little slackness of the wire 700. Consequently, when the manual tray 240 rotates again so as to uncover the opening 290 of the housing 200, the arm 520 bound to the manual tray 240 is displaced by the wire 700 so as to project from the housing 200.

The arm 520 also includes a third connecting potion 525 which is formed between the first and second connecting portions 522, 523. A second connecting hole 526 is formed on the third connecting potion 525.

As shown in FIG. 3, the supporting structure 600 also includes a supporting piece 630 which is connected to the inner wall 250 situated between the transmission gear 430 and the arm 520. The inner wall 250 supports the arm 520 via the supporting piece 630. In the present embodiment, the inner wall 250 is exemplified as the supporting plate.

As shown in FIGS. 9A and 9B, the supporting piece 630 includes a base shaft portion 631 which is connected to the inner wall 250. As shown in FIGS. 7A and 7B, the supporting piece 630 also includes a second connecting pin 632 which is inserted into the second connecting hole 526 formed on the third connecting potion 525 of the arm 520. As shown in FIGS. 3 and 7B, the supporting piece 630 also includes a connecting plate 633 which connects the base shaft portion 631 to the second connecting pin 632. The supporting plate 630 rotates around the base shaft portion 631 in response to displacement of the arm 520. The displacement of the arm 520 in response to rotation of the manual tray 240 moves along a prescribed travelling path due to the first and second connecting pins 515, 632, which results in stable displacement of the arm 520.

Arch guide holes 255, 256 are formed on the inner wall 250. The first connecting pin 515 is inserted into the guide hole 255. As shown in FIGS. 9A and 9B, the second connecting pin 632 is inserted into the guide hole 256. In the present embodiment, the guide hole 255 corresponding to the first connecting pin 515 is combined with the through hole 253. Alternatively, the guide hole corresponding to the first connecting pin may be separated from the through hole.

As shown in FIG. 7A, when the manual tray 240 rotates downwards, the arm 520 lies over upper surfaces of the supporting block 610 and the protecting block 620. A shape of the upper surfaces of the supporting block 610 and the protecting block 620 follows the arm 520. Therefore, when the manual tray 240 is rotated downwards, an excessively large stress is less likely to happen to the first and second connecting pins 515, 632 even if a downward external force is applied to the tip 524 of the arm 520 which projects from the housing 200.

When the manual tray 240 is rotated upwards, the tip 524 of the arm 520 hits the manual tray 240. The arm 520 is then pushed inside the internal space 260 of the housing 200 by the manual tray 240. As described above, the first and second connecting pins 515, 632 move along the guide holes 255, 256 in response to displacement of the arm 520. Consequently, the arm 520 is displaced upwards as shown in FIG. 7B to separate from the upper surfaces of the supporting block 610 and the protecting block 620.

Figure 10A:
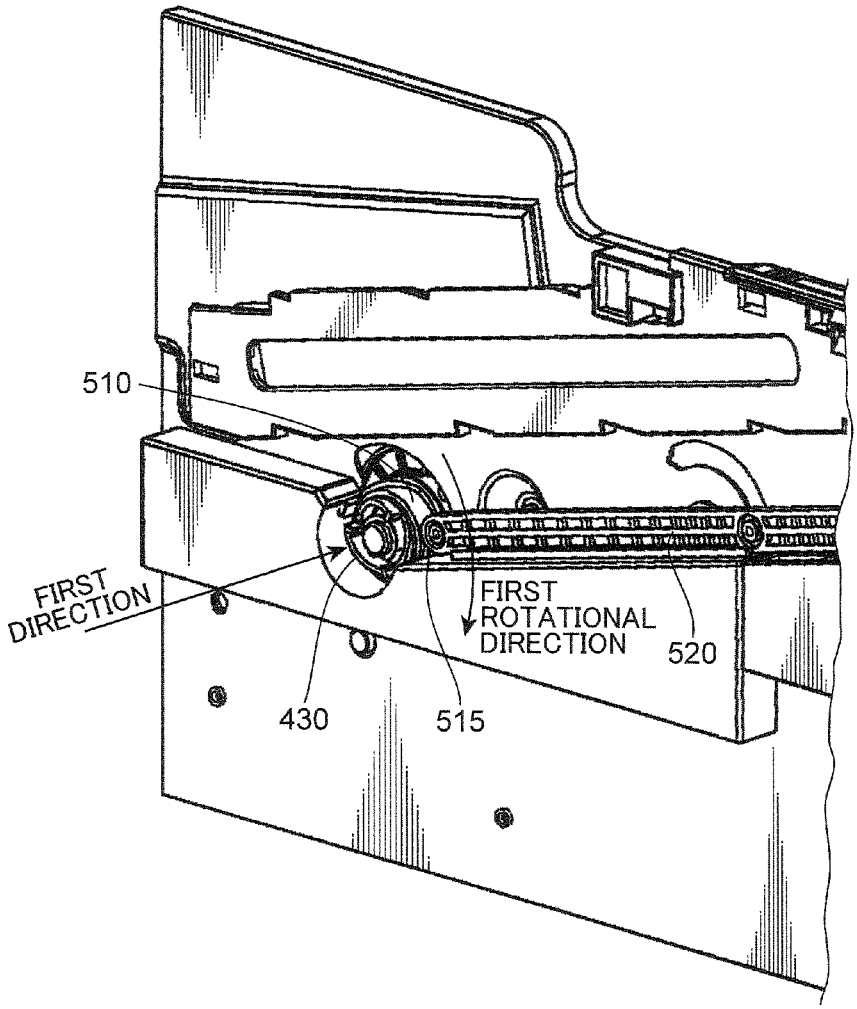
FIG. 10A is a schematic enlarged perspective view around a first connecting pin shown in FIG. 6A.
Figure 10B:
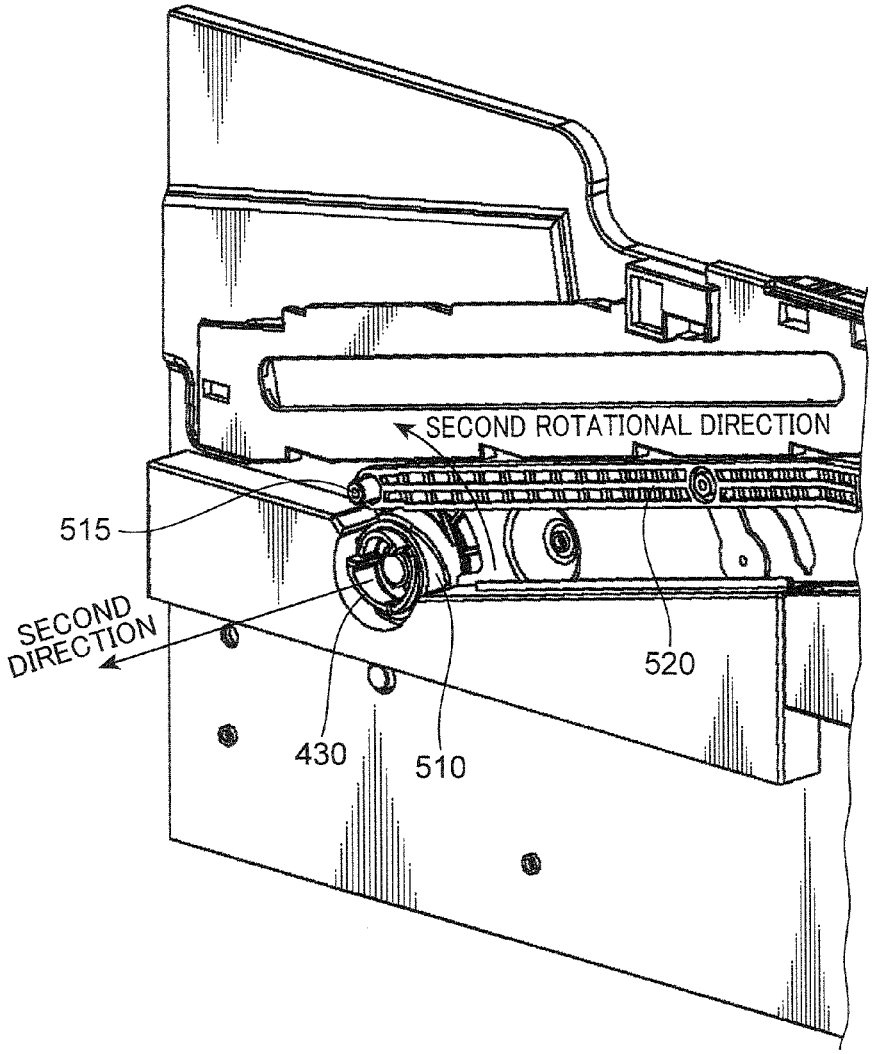
FIG. 10B is a schematic enlarged perspective view around the first connecting pin shown in FIG. 6B.

FIG. 10A is a schematic enlarged perspective view around the first connecting pin 515 which is rotated in the first rotational direction. FIG. 10B is a schematic enlarged perspective view around the first connecting pin 515 which is rotated in the second rotational direction. Rotation of the clutch ring 510 is described with reference to FIGS. 2, 3, 6A to 7B and FIGS. 10A and 10B.

As shown in FIGS. 7A and 7B, when the manual tray 240 is rotated so as to uncover the opening 290 of the housing 200, the arm 520, which is coordinated with the manual tray 240 by the wire 700, is displaced downwards. In this case, the first connecting pin 515 is moved downwards along the guide hole 255. Consequently, the clutch ring 510 rotates in the first rotational direction. As described with reference to FIGS. 6A and 6B, the clutch ring 510 rotated in the first rotational direction is displaced in the first direction and hits the transmission gear 430 to displace the transmission gear 430 in the first direction.

As shown in FIGS. 7A and 7B, when the manual tray 240 is rotated so as to cover the opening 290 of the housing 200, the arm 520 which is pushed into the housing 200 by the manual tray 240 is displaced upwards. In this case, the first connecting pin 515 moves upwards along the guide hole 255. Consequently, the clutch ring 510 rotates in the second rotational direction. As described with reference to FIGS. 6A and 6B, the clutch ring 510 which rotates in the second rotational direction is displaced in the second direction. Consequently, the coil spring 420 extends and displaces the transmission gear 430 and the clutch ring 510 in the second direction.

The principles of the present embodiment are applied to the photosensitive drum 121 of the image forming portion 120. Alternatively, the principles of the present embodiment may be applied to driving equipment other than an image forming apparatus (e.g., a fixing apparatus configured to fix toner images). Alternatively, the principles of the present embodiment may be applied to a processing apparatus configured to carry out prescribed processes other than image formation.

Although the present disclosure is fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus including an image forming portion which forms an image, the apparatus comprising:

a housing including a rotatable cover member configured to cover and uncover an opening in communication with an internal space in which the image forming portion is situated;

a drive portion which generates a drive force to drive the image forming portion; and a clutch mechanism configured to intermittently transmit the drive force from the drive portion to the image forming portion, wherein the clutch mechanism includes:

(i) a transmission member with a first transmission portion, which receives the drive force from the drive portion, and a second transmission portion, which engages with the image forming portion;

(ii) a link mechanism configured to reciprocate the transmission member in a first direction, in which the transmission member moves away from the image forming portion, and a second direction opposite to the first direction; and (iii) a flexible linker configured to link the cover member with the link mechanism;

the link mechanism coordinating with the cover member by means of the linker when the cover member uncovers the opening moves the transmission member in the first direction;

the link mechanism coordinating with the cover member by means of the linker moves the transmission member in the second direction when the cover member covers the opening the second transmission portion includes an engagement shaft configured to project from the first transmission portion to the image forming portion;

the housing includes a supporting structure configured to support the link mechanism;

the link mechanism includes:

(iv) a clutch ring with an inner surface configured to define an insertion bore, into which the engagement shaft is inserted, an outer surface opposite to the inner surface, a projecting surface, which hits and pushes the transmission member in the first direction when the cover member uncovers the opening, and a first connecting pin, which projects towards the image forming portion;

(v) an arm having a first connecting portion provided with a first connecting member, to which the first connecting pin is connected, and a second connecting portion, to which the linker is connected; and (vi) a bias member configured to bias the transmission member in the second direction;

the outer surface includes an inclination surface which extends in a circumferential direction of the outer surface and is inclined so as to approach the projecting surface;

the supporting structure includes a hook configured to contact the inclination surface;

the arm displaced by the linker rotates the clutch ring in a first rotational direction around the insertion bore when the cover member uncovers the opening; and the hook sliding over the inclination surface during rotation of the clutch ring in the first rotational direction pushes the clutch ring in the first direction to disengage the engagement shaft from the image forming portion.

2. The image forming apparatus according to claim 1, wherein the arm extending from the first connecting portion to the cover member covering the opening includes a tip which projects from the housing through the opening when the cover member uncovers the opening;

the cover member rotating to cover the opening hits the tip to displace the arm;

the arm displaced by the cover member rotates the clutch ring in a second rotational direction opposite to the first rotational direction around the insertion bore; and the bias member displaces the transmission member and the clutch ring in the second direction during rotation of the clutch ring in the second rotational direction.

3. The image forming apparatus according to claim 2, wherein the arm includes a third connecting portion formed between the first and second connecting portions;

the supporting structure includes:

a supporting plate configured to support the arm; and a supporting piece with a base shaft portion, which is connected to the supporting plate, and a second connecting pin, which is connected to a second connecting member formed on the third connecting portion; and the first and second connecting pins displace the arm along a prescribed path.

4. The image forming apparatus according to claim 3, wherein the first and second connecting pins are connected to arch guide portions which are formed on the supporting plate; and the first and second connecting pins move along the guide portions during displacement of the arm.

5. The image forming apparatus according to claim 4, wherein the supporting plate situated between the transmission member and the arm includes a first surface, which faces the transmission member, and a second surface, which faces the image forming portion; and the clutch ring and the engagement shaft project from the second surface through the supporting plates.

6. The image forming apparatus according to claim 5, wherein the supporting structure includes a supporting block configured to support the clutch ring which allows insertion of the engagement shaft projecting from the second surface through the supporting plate;

the supporting block includes a notch surface configured to define a notch in which the clutch ring is stored; and the hook projects from the notch surface.

7. The image forming apparatus according to claim 6, wherein the supporting structure includes a C-shaped ring configured to surround the notch surface; and the C-shaped ring includes an end used as the hook.

8. The image forming apparatus according to claim 1, wherein the clutch ring includes a facing end configured to face the image forming portion; and the engagement shaft includes an engaging end which projects from the facing end and engages with the image forming portion to transmit the drive force to the image forming portion.

9. A processing apparatus with a processing portion for carrying out a prescribed process, the apparatus comprising:

a housing including a rotatable cover member configured to cover and uncover an opening in communication with an internal space in which the processing portion is stored;

a drive portion which generates a drive force to drive the processing portion; and a clutch mechanism configured to intermittently transmit the drive force from the drive portion to the processing portion, wherein the clutch mechanism includes:

(i) a transmission member with a first transmission portion, which receives the drive force from the drive portion, and a second transmission portion, which engages with the processing portion;

(ii) a link mechanism configured to reciprocate the transmission member in a first direction, in which the transmission member moves away from the processing portion, and a second direction opposite to the first direction; and (iii) a flexible linker configured to link the cover member to the link mechanism; and the link mechanism moves the transmission member in the first direction when the cover member uncovers the opening;

the link mechanism moves the transmission member in the second direction when the cover member covers the opening the second transmission portion includes an engagement shaft configured to project from the first transmission portion to the image forming portion;

the housing includes a supporting structure configured to support the link mechanism;

the link mechanism includes:

(iv) a clutch ring with an inner surface configured to define an insertion bore, into which the engagement shaft is inserted, an outer surface opposite to the inner surface, a projecting surface, which hits and pushes the transmission member in the first direction when the cover member uncovers the opening, and a first connecting pin, which projects towards the image forming portion;

(v) an arm having a first connecting portion provided with a first connecting member, to which the first connecting pin is connected, and a second connecting portion, to which the linker is connected; and (vi) a bias member configured to bias the transmission member in the second direction;

the outer surface includes an inclination surface which extends in a circumferential direction of the outer surface and is inclined so as to approach the projecting surface;

the supporting structure includes a hook configured to contact the inclination surface;

the arm displaced by the linker rotates the clutch ring in a first rotational direction around the insertion bore when the cover member uncovers the opening; and the hook sliding over the inclination surface during rotation of the clutch ring in the first rotational direction pushes the clutch ring in the first direction to disengage the engagement shaft from the image forming portion.

* * * * *